United States Patent [19]

Graninger et al.

[11] 4,445,013

[45] Apr. 24, 1984

[54] MOMENTARY-MAINTAINED LEVER OPERATED PUSHBUTTON

[75] Inventors: Frank J. Graninger, Milwaukee; Gilbert A. Reichert, Greendale, both of Wis.

[73] Assignee: Allen-Bradley Company, Milwaukee, Wis.

[21] Appl. No.: 496,828

[22] Filed: May 23, 1983

[51] Int. Cl.[3] ..... H01H 15/18

[52] U.S. Cl. ..... 200/77; 200/50 C

[58] Field of Search ..... 200/67 G, 69, 72 R, 200/77, 62, 50 C

[56] References Cited

U.S. PATENT DOCUMENTS

| | | | |
|---|---|---|---|
| 1,098,849 | 6/1914 | Smart et al. | 200/77 |
| 1,186,586 | 6/1916 | Klein | 200/77 |
| 2,050,076 | 8/1936 | Wilms | 361/28 |
| 2,496,282 | 2/1950 | Frese | 200/16 A |
| 2,595,414 | 5/1952 | Schaefer | 200/5 R |
| 3,320,395 | 5/1967 | De Smidt | 200/302 |
| 3,331,931 | 7/1967 | Carter | 200/50 R |
| 3,388,228 | 6/1968 | Nagy | 200/153 R |
| 3,402,620 | 9/1968 | Mukai et al. | 74/483 R |
| 3,514,554 | 5/1970 | Boysen | 200/16 R |
| 4,177,363 | 12/1979 | Keranen | 200/50 C |

OTHER PUBLICATIONS

Allen-Bradley Co. Drawings: 40265-002 -003 -004 -005 -022 -051

*Primary Examiner*—John W. Shepperd
*Assistant Examiner*—Renee S. Kidorf
*Attorney, Agent, or Firm*—Arnold J. Ericsen

[57] ABSTRACT

An improved momentary-maintained operating assembly for an electrical switch, including normally-closed maintained contacts and normally-open momentary contacts; lever operated overcenter, toggle mechanism including a stationary support pivotally supporting an operating cambeam member; a maintained and a momentary pushplate pivotally attached to rock the cambeam member on its pivot; spring members attached to cam follower rollers operating on convex cam surfaces of the cambeam member, with the spring members biasing the rollers towards the respective cam surfaces; the opposite ends of the pushplates being pivotally fastened to a yoke plate fastened to and rocked in alternative directions by the lever to operate the respective pushplates in maintained or momentary contact relationship; and separate spring means biasing the momentary pushplate away from contact operation.

5 Claims, 5 Drawing Figures

MOMENTARY-MAINTAINED LEVER OPERATED PUSHBUTTON

BACKGROUND OF THE INVENTION

1. Field of the Invention

The invention relates to an enclosed electrical switching station, and it resides more specifically in a momentary-maintained mechanism actuated by a lever-operated switch.

2. Description of the Prior Art

Momentary-maintained electrical switches have been provided for special motor control applications as disclosed in the G. 0. Wilms U.S. Pat. No. 2,050,076, assigned to the same assignee as is the present invention. Wilms is illustrative of a momentary-maintained pushbutton station having a maintained contact in the form of a conducting ring encircling a fiber disc and carried by the lower stem of an axially moveable "stop" button. The conducting ring is normally engaged by two inwardly biased spring metal terminal members. The "start" button provides a conducting disc member arranged for momentary engagement with spaced apart terminal members. The stem of this button includes radially extending flanges engageable with opposite sides of one end of a pivoted lever member for moving the lever in opposed axial directions. The opposite end of the lever releaseably engages the fiber member of the "stop" button.

The Wilms patent taught a relatively simple arrangement, but required terminals or stationary contacts specifically designed for the particular application.

Later, there were provided pushbutton stations containing a selection of contact modules of varying contact configurations, assembled in accordance with the desires of an ultimate user. The operating mechanism of these comprised a button-type actuator of a particular configuration which would cooperate with any of the several modular contact blocks. This arrangement permitted an electrician to add individual contact blocks or modules in various combinations, all of which combinations could be operated from the same type of actuating mechanism. Obviously, this construction required that an over-center, toggle arrangement be built into the actuator mechanism, rather than in the individual contact assembly as was disclosed in the Wilms patent.

Lever-operated switch mechanisms were later introduced as taught in the DeSmidt U.S. Pat. No. 3,320,395 for use with certain type of enclosures. This construction used a contact block which was limited to a specific contact arrangement, and not of the momentary-maintained operation of the Wilms as is the present invention. Momentary-maintained, lever-actuated, contact arrangements utilizing modules, such as those of the Boysen U.S. Pat. No. 3,514,554, were not available until the conception of the present invention. Both the Boysen and DeSmidt patents were also assigned to the assignee of the present invention.

SUMMARY OF THE INVENTION

The present invention introduces an operating mechanism for momentary-maintained actuation of a lever operated electrical switch station. That station, itself, is similar to that disclosed in DeSmidt. As was brought forth in DeSmidt, lever-operated switch stations permit the use of contact members enclosed within housings designed especially for location in hazardous or deleterious ambient surroundings.

The present invention presents means for utilizing and combining the desired DeSmidt lever operation combined with contact block modules not unlike those disclosed in the aforementioned Boysen patent, and which futher provides a momentary-maintained contact arrangement.

Specifically, the present invention provides a momentary-maintained operating assembly for an electrical switch which includes a support member with an internal cavity and a rotatable shaft traversing the cavity and in operable engagement with a yoke plate member positioned substantially normal to the rotational axis of the shaft and which is rotatable therewith; an external lever arm is arranged to rotate the shaft in alternative contact-operating positions; oppositely disposed momentary and maintained pushplates at either side of the yoke plate member are pivotally attached to that member; means are provided for operatively, rotatably engaging transversly disposed roll pins at the opposite ends of each pushplate, with the pushplates including finger portions for releasable engagement with separate contact block operating members; a pivotable cambeam member with longitudinally spaced apertures also receives the roll pins, and the cambeam member includes convex cam surfaces at opposite ends thereof; a stationary mounting bracket with upright sides pivotally supports the cambeam member intermediates its ends with the upright sides including longitudinal slots at opposite ends thereof for rotatably and slideably receiving cam follower rollers, along with biasing means for biasing the rollers towards one another and towards the respective convex cam surfaces for overcenter, toggle operation; and compression spring means for the momentary pushplate which bias as the pushplate and its attached yoke plate member away from the stationary bracket, and wherein the momentary pushplate further defines the rollpin-receiving aperature as being elongated longitudinally of the pushplate to permit a "lost" motion for momentary action against the operating member of a normally open contact assembly responsive to rotation of the lever arm, whereas operation of the lever arm in an opposite direction causes the maintained pushplate to engage the operating member of a normally open contact assembly.

BRIEF DESCRIPTION OF THE DRAWINGS

FIG. 3 illustrates a "start/stop" arrangement, the "stop" position of the lever arm operator actuates the contacts of separate contact modules in open circuit relationship; whereas, the view of FIG. 4 indicates the relative contact operating arrangement immediately following manual release of the lever arm after rotating to "start" position, wherein the left-hand (momentary contact module) contacts are open and the right hand (maintained contact module) contacts are closed. The view of FIG. 5 illustrates the "momentary" operation with both sets of contacts in circuit closed position.

DESCRIPTION OF THE PREFERRED EMBODIMENT

Figure 1:
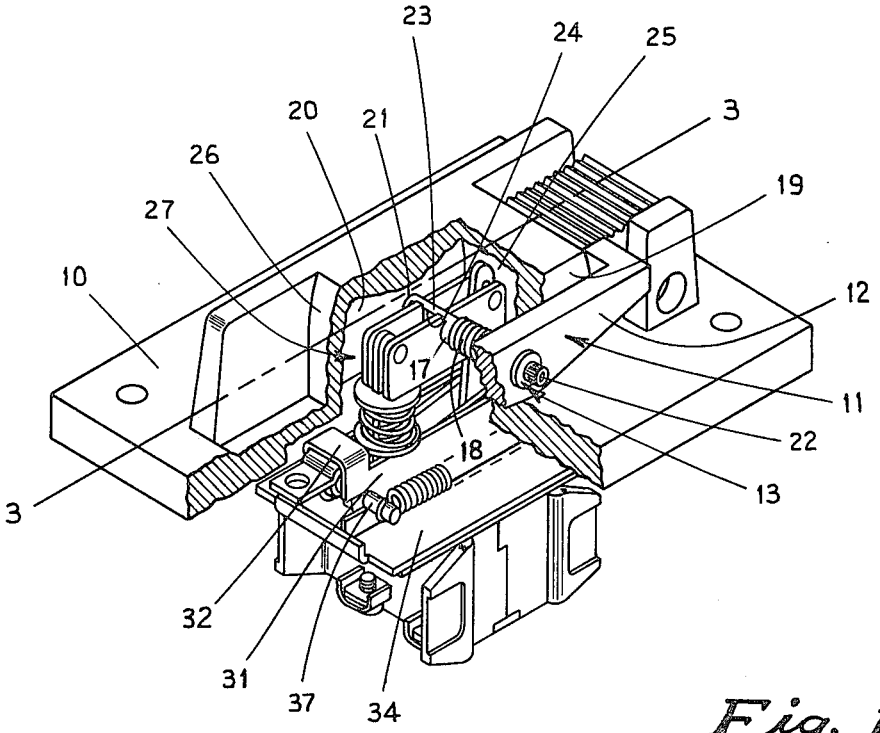
FIG. 1 is a perspective view, with parts broken away and in section, of a cover assembly for a switch housing and having contact actuating means constructed in accordance with this invention.
Figure 2:
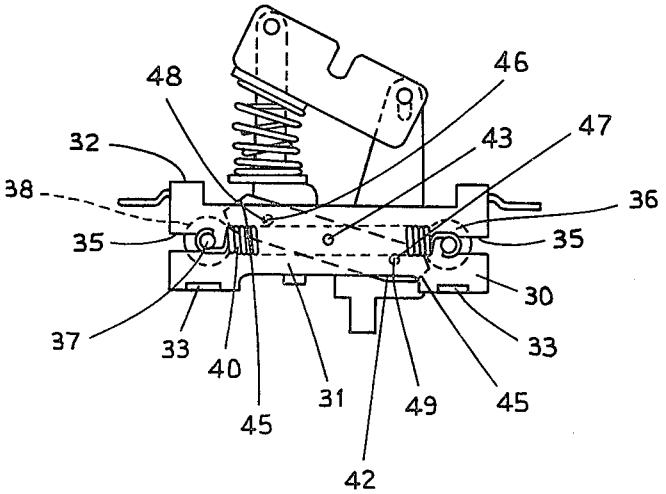
FIG. 2 is a side elevational view of the contact actuator assembly constructed in accordance with this invention.

With initial reference to FIGS. 1 and 2 of the drawings, it will observed that the present invention may find application in an enclosed electrical switching station not unlike that disclosed in the DeSmidt U.S. Pat. No. 3,320,395. It will be apparent, however, from the ensuing description that the operating mechanism of the present invention may also be assembled directly to a panel or other relatively flat supporting member without departing from the scope of the invention.

In the present embodiment, there is provided a supporting member, indicated generally by the reference numeral 10, in the form of a cover assembly for an enclosure base (not shown). The cover assembly 10 includes an external actuating lever arm 11. The actuating lever arm 11 includes a shank portions 12 (only one being shown) which extend radially from opposite sides of a pivot assembly 13. The oppositely disposed shank portions 12 each terminate in serrated finger pads 14 and 15. Pads 14 and 15 each preferably extend substantially normal to the longitudinal axis of the shank portions 12 and are spaced above the assembly 10.

The pivot assembly 13 comprises a rotatable shaft 17 with a threaded portion 18 engaging a threaded aperture (not shown) in a side wall 19. This arrangement provides secure support, since the shaft 17 is reduced in diameter at its innermost end, and does not extend through the opposite side wall 20. The distal end portion of the shaft 17 rests in a re-entrant opening 21 located interiorally of the side wall 20. The shaft 17 protrudes externally of the wall 19 to receive the lever arm 11, which is secured to the shaft by means of a set screw 22. It will be further observed that the reduced portion 23 of the shaft 17 includes a flattened surface area 24 for purposes hereinafter described.

The side walls 19 and 20, along with end walls 25 and 26 define an internal cavity indicated generally by the reference numeral 27. The cavity 27 is arranged to receive the various components of the operating mechanism of this invention, as will later be discussed.

With specific reference to the assembly disclosed in FIGS. 1 and 2, there is shown a stationary mounting bracket 30 having a U-shaped cross-section defining integral upright sidewalls 31 depending from a platform portion 32. The bracket 30 is secured to mounting straps 33 at its base by means of riveting or other fastening procedure. The straps 33 are apertured to receive rivets (not shown) for mounting directly to a mounting plate 34 (See FIG. 1).

The upright sidewalls 31 of the bracket 30 are each provided with oppositely disposed longitudinal slots 35 extending inwardly from the opposite ends of the sides. Seated in the respective slots 35 are a pair of cam follower rollers 36 extending transversally of the sidewalls 31, and having a reduced diameter portion extending outwardly therefrom. The rollers 36 have enlarged diameters intermediate their ends to define cam follower portions 38. Also attached to each of the reduced diameters portions 37 of the rollers 36 are the hooked ends of coiled tension springs 40 located at either side of the bracket and externally of the upright sides 31. The springs 40 bias the cam follower rollers 36 in a direction towards one another for purposes hereinafter described.

The operating mechanism further includes a pair of stamped cambeam members 42 rotatably supported by a pivot pin 43 located transversely of the bracket 30 and extending through registering apertures in each of the respective upright sides 31. The cambeam members 42 are provided with oppositely disposed convex cam surfaces 45 bearing against the enlarged portions 38 of the cam follower rollers 36 to provide an overcenter, toggle operation against the bias of the tension springs 40. At either side of the pivot pin 43 are apertures 46 and 47, which respectively receive pivot pins 48 and 49.

A maintained pushplate 50 is rotatably and pivotally attached to the cambeam members 42 by means of the pivot pin 49, whereas a momentary pushplate 51 is slideably and rotatably attached to the opposite end of the cambeam member 42 by means of the pivot pins 48. It will be observed that the momentary pushplate 51 contains an elongated aperature 52 for receiving the pin 48, whereas the elongated aperature 53 in the maintained pushplate 50 receives a pivot pin 55. This arrangement provides "lost motion" to permit momentary operation of normally opened contacts, as will hereinafter be described. The pivot pin 55 is located at one end of a pair of yoke plate member 56, which is notched at 57 to receive the flattened surface portion 24 of the shaft 17. Oppositely spaced from the notch 57 there is located a pivot pin 58 for receiving the uppermost end of the momentary pushplate 51.

To complete the operating mechanism, there is provided a helical compression spring 60, the opposite ends of which bear against washers 61. The washers 61 respectively bear against the stationary mounting bracket member 30 and against the bottom of the yoke plates 56.

Also supported from the mounting plate 34 are a pair of contact modules 64, 65 constructed in accordance with the teachings of the aforementioned Boysen U.S. Pat. No. 3,514,554. For the purposes of a momentary-maintained operation, and as viewed in FIG. 4, module 64 contains normally opened contacts, whereas the module 65 contains normally closed contacts.

Figure 3:
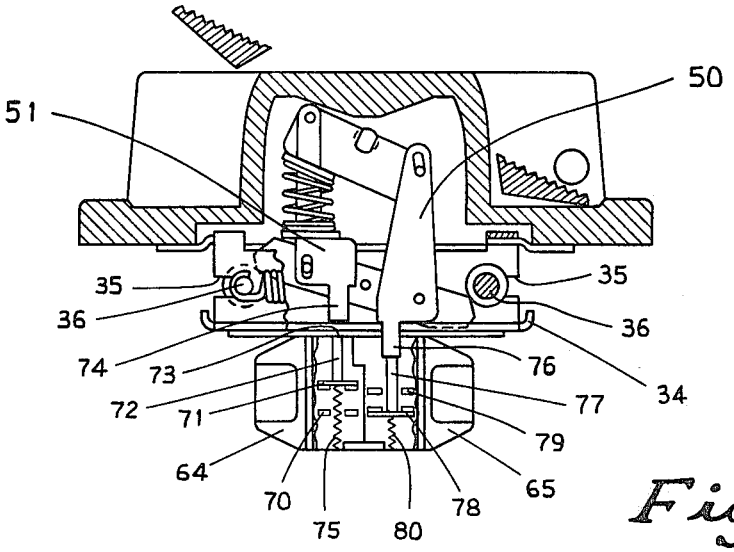
FIGS. 3–5, inclusive, are side elevational views taken along the sectional line 3—3 of FIG. 1, and showing the various cooperating elements relative "momentary" and "maintained" contact operating position. Specifically.
Figure 4:
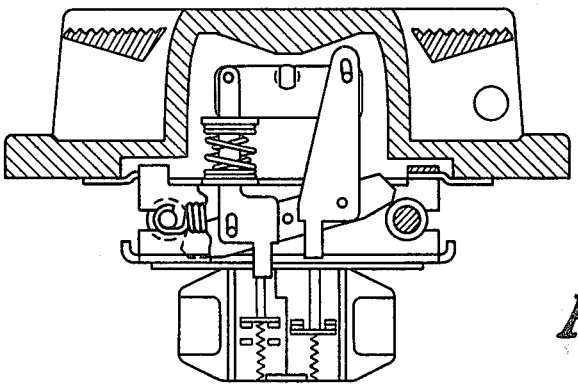
Figure 5:
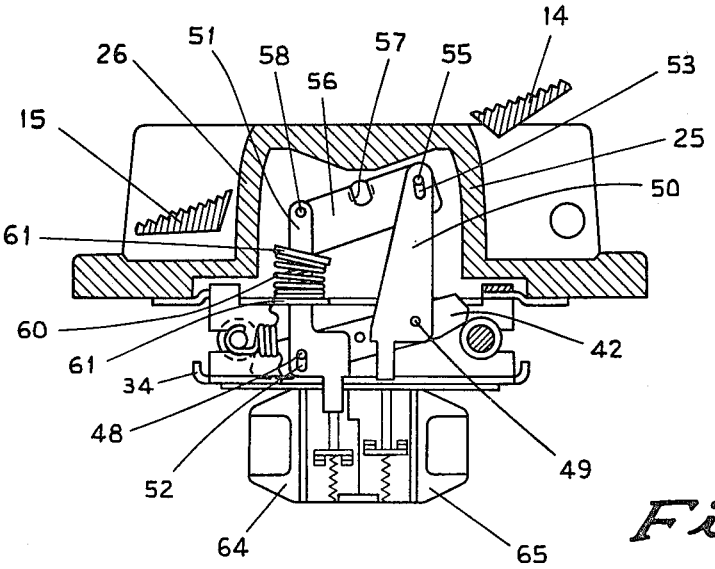

With particular reference to FIGS. 3–5, inclusive, each of which contain partially broken away views of the modules 64 and 65, it will be observed that the module 64 includes a pair of stationary contacts 70 and a cooperating, normally open, movable contact spanner 71 for completing an electrical circuit with the stationery contacts upon downward movement of the operating stem 72. The uppermost surface 73 of the stem 72 is releasably engageable with a finger portion 74 on the momentary pushplate 51.

Again, with reference to FIG. 3, it will be observed that the finger portion 76 of the maintained pushplate 50 releasably engages the stem 77 for operation of a moveable contact spanner 78, shown here in closed operating position abutting the stationary contacts 79 of the maintained contact module 65. The springs 75 and 80 are arranged to bias the respective spanners 70 and 78 upwardly relative to the views of FIGS. 3–5, inclusive.

The operation of the improved mechanism is best described with attention to the views of FIGS. 3–5, inclusive. As shown in FIG. 3, the lever arm 11 has been rotated upon manual depression of the finger pad 14 the "stop" position. The "start/stop" circuit arrangement has particular application in for controlling electric motors or the like. The shaft 17 is simultaneously rotated with the lever arm 11 to rock the yoke plate member 56 and thereby depress the maintained pushplate 50 downwardly to the position shown in FIG. 3. It will be observed that the pivot pin 55 has been forceably moved downwardly within the elongated aperture 53 to force the finger portion 76 of the pushplate 50 against the stem 77 of the movable spanner 78 against the bias of its spring 80 and away from the stationary contacts 79. This action is simultaneously accomplished with a "snap" operation, by a overcenter toggle mechanism comprising the helically wound tension springs 40 which bias the rollers 36 towards one another and with their respective cam follower portions 38 bearing against the opposite ends of the convex cam surfaces 45 of the respective cam beam members 42. Here, it will be observed that right hand cam follower roller is shown at the top of the cam surface, whereas the lefthand cam follower roller 36 is at the lower portion of the cam surface to provide a strong bias for maintaining the contact members 78 and 79 in maintained-open circuit position for the "stop" operation. It will also be observed that the contact spanner 71 of the momentary contact module 64 has been opened against the bias of the spring 75, to a circuit open position with respect to stationary contacts 70.

The circuit "start" position of FIG. 4 is of interest, since the view of FIG. 4 illustrates the relative positions of the respective finger pads 14 and 15 of the lever arm 11 immediately following depression and manual release of the "start" finger pad 15. It will be observed that both finger pads 14 and 15 are lying in a generally horizontal position with respect to FIG. 4. Here, earlier manual depression of finger pad 15 has caused the cambeam member 42 to be rocked on its pivot 43 to the position shown in FIG. 4 against the bias of the springs 40 to provide an overcenter toggle action. Thus, the maintained pushplate 50 will have been raised to the position shown, with its finger portion 76 being disengaged from the stem 77 attached to the movable spanner 78, to cause the bias of the spring 80 to force the spanner 78 against the stationary contacts 79 of the maintained contact module 65.

Because of the "lost motion" permitted by the elongated apertures 52 and 53 of the respective pushplates 51 and 50, and because of the bias of the spring 60, the mechanism is now set for "momentary" manual operation of the finger pad 15. It will be further observed that the movable contact spanner 71 will have been biased towards open position by its spring 75 away from the stationary contacts 70 of the momentary contact module 64.

Referring now to the view of FIG. 5, it will be observed that the finger pad 15 is shown in the depressed position, but with the cambeam member 42 remaining in the same position as it was in FIG. 4 against the strong bias of the springs 40 on the cam follower rollers 36. The manual pressure of the finger pad 15 causes the finger portion 74 of the momentary pushplate 51 to be depressed against the stem 72 of the momentary contact module 64 to momentarily force the movable contact spanner 71 into closed circuit position relative to the stationary contacts 70. Manual release of the finger pad 15 will permit the lever arm 11 to return to the rest position of FIG. 4 with the respective contact 70 and 71 being positioned in contact open position. The maintained contacts 78 and 79 will remain in static relationship during this momentary manual operation of the lever arm 11. It will be apparent that other contact modules (not shown) may be attached for operation in a manner similar to that shown in the aforementioned Boysen patent, and that the specific mechanism and configuration shown herein may be adopted for use other than "start/stop" mechanism without departing from the spirit of the invention, which resides in particularly in the combination of the elements as in hereinafter more fully described by the appended claims.

The embodiments of the invention of which an exclusive property or privilege is claimed are defined as follows:

1. A momentary-maintained operating assembly for an electrical switch comprising, in combination:

a support member defining an internal cavity therein, and a shaft receiving aperture therethrough;

a rotatable operating shaft having a portion extending internally of said support member through said aperture;

an external lever arm engaged with and arranged to rotatably operate said shaft;

a yoke plate member operably engaging and rotatable with said operating shaft;

a momentary and a maintained pushplate respectively pivotally supported and depending from said yoke plate member, and each pushplate respectively pivotally and operatively engaging a pivotably supported cambeam member, said cambeam member defining overcenter cam surfaces at opposite ends thereof;

stationary mounting means pivotally supporting said cambeam member, cam follower means operatively engaging the respective cam surfaces of said cambeam member and biased towards said cam surfaces to provide overcenter toggle operation of said cambeam member and the respective pushplates;

momentary biasing means for said momentary pushplate and biasing said momentary pushplate in a direction away from said stationary mounting means; and a pair of contact blocks, one of said pair containing a stationary contact and a movable contact, biasing means biasing said movable contact towards normally closed position relative to said stationary contact, and an operator for said movable contact releasably engageable with said maintained pushplate, the other of said pair of contact blocks containing a stationary contact, a movable contact and means biasing said movable contact towards normally open position relative to said stationary contact, said movable contact releasably engageable with said momentary pushplate.

2. The momentary-maintained operating assembly of claim 1, wherein said mounting means comprises an elongated bracket of U-shaped cross section defining upright sidewalls, and wherein the sidewalls are apertured to receive a cambeam supporting pivot pin and are each longitudinally slotted at opposite ends, and wherein said cam follower means comprise biased cam follower rollers respectively bearing against the oppositely disposed cam surfaces of said cambeam member.

3. The momentary-maintained operating assembly of claim 2, wherein said cam follower rollers are biased in a direction towards one another by a pair of tension springs attached at opposite sides of said rollers.

4. The momentary-maintained operating assembly of claim 1, wherein said momentary pushplate includes an elongate aperture for receiving the pivot support of said yoke plate member and wherein said maintained pushplate includes an elongate aperture for receiving the pivot support of said cambeam member, said momentary biasing means comprising a compression spring surrounding said momentary pushplate and biasing said momentary pushplate in a direction towards contact open position for return to normal operating position following release from momentary contact closure.

5. A momentary-maintained operating assembly for an electrical switch comprising, in combination:

a support member defining an internal cavity therein, and a shaft receiving aperture therethrough;

a rotatable operating shaft having a portion extending internally of said support member through said aperture, said internally located shaft portion including a relatively flat surface area;

an external lever arm engaged with and arranged to rotatably operate said shaft;

a yoke plate member having a notched portion engaging the flattened surface area of said shaft, said yoke plate member positioned substantially normal to the rotational axis of said shaft and being rotatable therewith;

a momentary and a maintained pushplate each having one end pivotally attached to said yoke plate member at opposite sides of said notched portion, and each pushplate being respectively apertured at its opposite end for operative engagement with a transversely disposed roll pin, said pushplates each having an integral finger portion extending longitudinally beyond said roll pin-receiving aperture; the roll pin-receiving aperture of said momentary pushplate being elongated longitudinally of said pushplate;

a pivotable, platelike cambeam member defining longitudinally spaced apertures for receiving said roll pins, said cambeam member defining convex cam surfaces at opposite ends thereof;

a stationary mounting bracket having oppositely disposed upright sides for pivotally supporting said cambeam member, each of said upright sides defining longitudinal slots extending inwardly from opposite ends thereof, cam follower rollers extending across said bracket and rotatably and slidably received by the respective longitudinal slots and biasing means for biasing said rollers towards one another;

a helical compression spring surrounding said momentary pushplate and located between said yoke plate member and said upright sides of said stationary bracket, said compression spring biasing said yoke plate member and said momentary pushplate in a direction away from said upright sides; and a pair of contact blocks supported by said mounting bracket, one of said pair of contact blocks containing a stationary contact and a movable contact, biasing means biasing said movable contact towards normally closed position relative to said statonary contact, and a movable contact operator protruding from one end of said one contact block and releasably engageable with the extending finger portion of said maintained pushplate, the other of said pair of contact blocks containing a stationary contact, a movable contact and biasing means biasing said movable contact towards normally open position relative to said statonary contact, and a movable contact operator releasably engageable with the extending finger portion of said momentary pushplate.

* * * * *